US009879848B2

(12) United States Patent
Su et al.

(10) Patent No.: US 9,879,848 B2
(45) Date of Patent: Jan. 30, 2018

(54) LED ILLUMINATION APPARATUS

(71) Applicant: National Taiwan University, Taipei (TW)

(72) Inventors: Guo-Dung Su, Taipei (TW); Chih-Hao Hsu, Taipei (TW)

(73) Assignee: NATIONAL TAIWAN UNIVERSITY, Taipei (TW)

( * ) Notice: Subject to any disclaimer, the term of this patent is extended or adjusted under 35 U.S.C. 154(b) by 0 days.

(21) Appl. No.: 15/178,015

(22) Filed: Jun. 9, 2016

(65) Prior Publication Data

US 2017/0205030 A1 Jul. 20, 2017

(30) Foreign Application Priority Data

Jan. 20, 2016 (TW) ..... 105101780 A

(51) Int. Cl.

| | |
|---|---|
| ***F21V 29/71*** | (2015.01) |
| ***B61D 29/00*** | (2006.01) |
| ***F21S 8/10*** | (2006.01) |
| ***F21V 7/04*** | (2006.01) |
| ***F21V 31/00*** | (2006.01) |

(52) U.S. Cl.

CPC ..... *F21V 29/717* (2015.01); *B61D 29/00* (2013.01); *F21S 48/1159* (2013.01); *F21S 48/1323* (2013.01); *F21S 48/1388* (2013.01); *F21S 48/328* (2013.01); *F21V 7/045* (2013.01); *F21V 31/005* (2013.01)

(58) Field of Classification Search

None

See application file for complete search history.

(56) References Cited

U.S. PATENT DOCUMENTS

2012/0140466 A1* 6/2012 Yang ..... F21K 9/137 362/235

FOREIGN PATENT DOCUMENTS

CN 204477822 U * 7/2015

* cited by examiner

*Primary Examiner* — Kristy A Haupt

(74) *Attorney, Agent, or Firm* — Rabin & Berdo, P.C.

(57) ABSTRACT

An LED illumination apparatus includes a first lighting module, a second lighting module, a lamp cup, a heat pipe, and a plurality of heat dissipation fins. The first and second lighting modules are connected with each other and emit light in opposite directions, in addition being received by the lamp cup. The lamp cup includes two reflecting surfaces arranged in symmetrical mirror fashion. The light emitting from the first and second lighting modules are directed to respective reflecting surfaces and reflected toward a same direction by the reflecting surfaces. The heat pipe is disposed in between the first and second lighting modules. The heat dissipation fins are fitted over the heat pipe. The heat generated by lighting modules would transmit to the heat pipe and be guided to the heat dissipation fins in order to accelerate cooling.

14 Claims, 4 Drawing Sheets

LED ILLUMINATION APPARATUS

CROSS-REFERENCES TO RELATED APPLICATIONS

This non-provisional application claims priority under 35 U.S.C. § 119(a) on patent application No. 105101780 filed in Taiwan, R.O.C. on Jan. 20, 2016, the entire contents of which are hereby incorporated by reference.

BACKGROUND

Technical Field

The instant disclosure relates to an LED illumination apparatus, in particular to an LED illumination apparatus having heat dissipating structures.

Related Art

Head lights of rail cars are different from typical illumination requirements. By considering the weight and speed of rail cars, its illumination is required to clearly illuminate objects far ahead on the rail, unlike typical indoor illumination for close distance and large area. Therefore, the light field associated with head lights of rail cars must meets specific regulations. Since for rail cars, its head lights must achieve a certain level of illumination for a specific distance and equivalent luminance, most rail cars today use conventional tungsten light bulbs. However, since tungsten light bulbs have a shorter service life and consume more power to reach certain illumination intensity, one of the major consequences is excessive temperatures.

Since tungsten light bulbs generate more heat, when the light bulbs are exposed continuously under excessive temperature condition, the service life of light bulbs is shortened. Other issues include increased replacement rate and maintenance fee.

With the advancement in light emitting diodes (LEDs), many LED-based products can replace existing tungsten light bulbs. But in order to meet the requirements of head lights for rail cars, since the head lights consume more power, the manufacturing price of the product is also higher. This scenario leads to higher sales price on the market. Since the illumination angle for the LED is only 180° , unlike 360° for tungsten light bulbs, the current remedy is to place a lens in front of the LED to concentrate light beams off the LED. However, during the manufacturing stage, because such practice requires concentrating each LED with the lens, the manufacturing process is more complicated relative to tungsten light bulbs. The manufacturing cost also increases since multiple lenses must be used.

SUMMARY

In one embodiment, the LED illumination apparatus comprises a first light emitting module, a second light emitting module, a lamp cup, a heat pipe, and a plurality of heat-dissipating fins. The first lighting module includes a first base, a first circuit board, and a plurality of first LEDs. The first LEDs are disposed on the first circuit board, while the first circuit board is disposed on a first surface of the first base. The second light emitting module includes a second base, a second circuit board, and a plurality of second LEDs. The second LEDs are disposed on the second circuit board, while the second circuit board is disposed on a first surface of the second base. Meanwhile, a second surface of the first base opposite to the first surface of the first base is mated with a second surface of the second base opposite to the first surface of the second base.

The lamp cup includes a first reflecting surface and a second reflecting surface. The first and second reflecting surfaces are disposed in a symmetrical mirror fashion and received by the lamp cup. The heat pipe is penetratingly disposed in between the first and second bases and extends surroundingly toward the rear of the lamp cup. One end of each of the heat-dissipating fins is fitted over the heat pipe, and the heat-dissipating fins are arranged surroundingly along the outer side surface of the lamp cup.

Based on the above structures, heat generation can be greatly reduced by the use of LEDs as the light sources. The up-and-down arrangement of the LEDs allows more LEDs to be used in order to achieve required illumination intensity. By penetratingly dispose the heat pipe 40 in between the first and second bases 11 and 21, heat originated from the first and second bases 11 and 21 can be effectively directed to the heat-dissipating fins 50 via the heat pipe 40. Multiple heat-dissipating fins 50 can effectively disperse heat to ambient air for enhancing heat-dissipation effect.

In some embodiments, the first LEDs of the first lighting module may face toward the first reflecting surface, while the second LEDs of the second lighting module may face toward the second reflecting surface. Thus, the first lighting module emits light toward the first reflecting surface, with the reflected light directed toward the front of the lamp cup. Likewise, the second lighting module emits light toward the second reflecting surface, with the reflected light directed toward the front of the lamp cup. Hence, the reflected light can be more concentrated toward a same direction, instead of overly dispersing. And no lenses are needs for disposing in front of the LEDs for concentrating light beams.

In some embodiments, the number of the first LEDs is four and the four first LEDs are arranged in a diamond-like pattern. Further, the first LED disposed at the front end of the diamond-like pattern is the focal point of the first reflecting surface. Thus, for light beams directed to the first reflecting surface by the first LEDs, a nearly hemispherical light field can be formed upon reflection. Meanwhile, for the second lighting module arranged oppositely of the first lighting module, same configuration can be used as well. That is to say the number of the second LEDs is four and the four second LEDs are arranged in a diamond-like pattern. Thus, for light beams directed to the second reflecting surface by the second LEDs, a nearly hemispherical light field can be formed upon reflection. Hence, for light beams emitted by the first and second lighting modules, a nearly spherical light field can be formed upon reflection by the first and second reflecting surfaces.

In some embodiments, the heat pipe includes a straight portion, a bent portion, and a loop portion. The straight portion is disposed in between the first and second bases, the bent portion is connected to the straight portion, and the loop portion is connected to the bent portion. The straight portion in between the first and second bases can direct heat to the bent and loop portions for heat dissipation.

In some embodiments, the bent and straight portions may jointly define a 90° angle. Further, the loop portion may extend hemispherically and define a virtual central axis at the center of the hemisphere, with the axis perpendicular to the radius thereof. The straight portion may be disposed along the central axis of the loop portion. Since the straight portion of the heat pipe is arranged along the central axis of the lamp cup, thus the loop portion of the heat pipe may be surroundingly disposed along the outer circumferential surface of the lamp cup. Since the heat-dissipating fins are spacingly disposed along the loop portion of the heat pipe, the heat-dissipating fins can be surroundingly arranged along the outer circumferential surface of the lamp cup. Thus, the overall volume of the LED illumination apparatus can be reduced while disposing as much dissipating fins as possible.

In some embodiments, the LED illumination apparatus further comprises a front cover, a glass cover, and a rear cover. The glass cover covers an opening defined by the lamp cup, the front cover is disposed in front of the lamp cup, and the rear cover is disposed at the rear of the lamp cup. The front cover, lamp cup, and the rear cover may be screwed together sequentially.

In some embodiments, the LED illumination apparatus further comprises a water-proofing rubber ring, where the rubber ring is disposed on the outer circumferential surface of the opening of the lamp cup and in between the lamp cup and glass cover. The rubber ring can prevent water or water vapor from intruding the lamp cup, so as to not damage the circuit boards and LEDs.

The embodiments below provide detailed description of the characteristics and advantages of the instant disclosure, such that a skilled person in the art may comprehend the technical features of the instant disclosure and put into practice.

DETAILED DESCRIPTION

Figure 1:
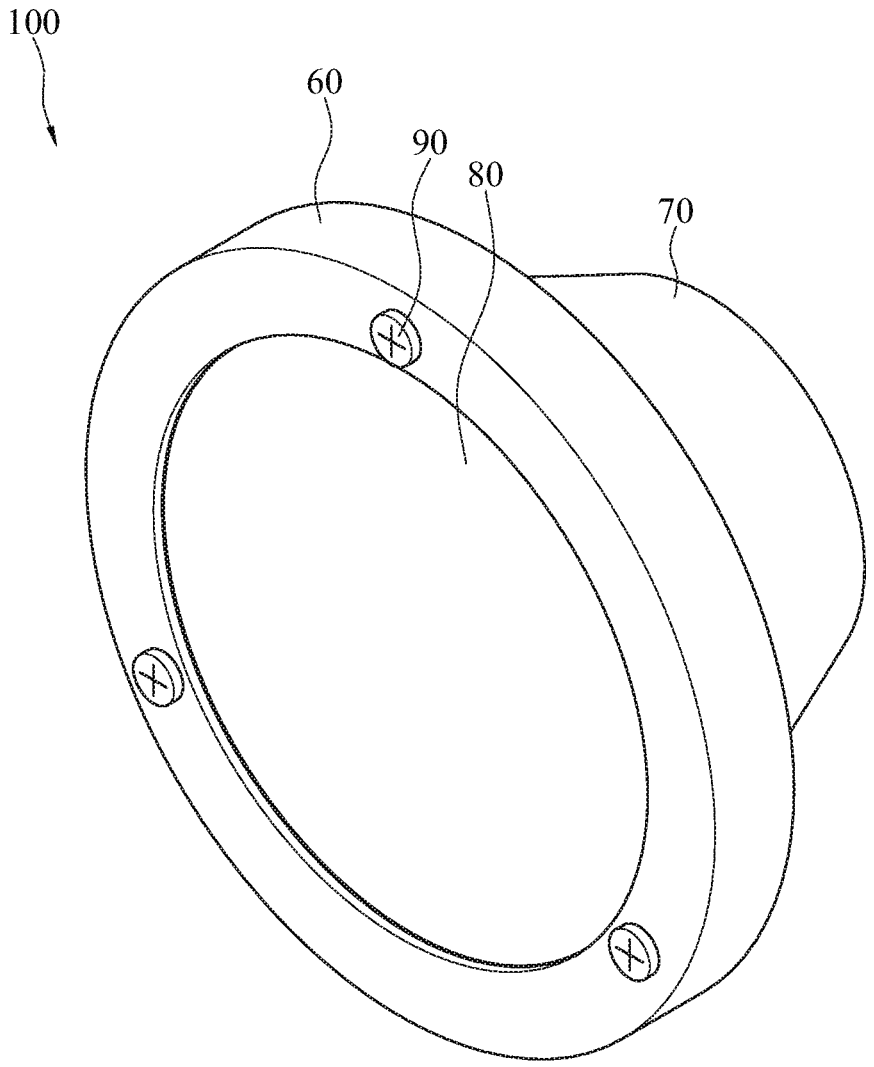
FIG. 1 is a schematic view of an LED illumination apparatus for one embodiment of the instant disclosure.
Figure 2:
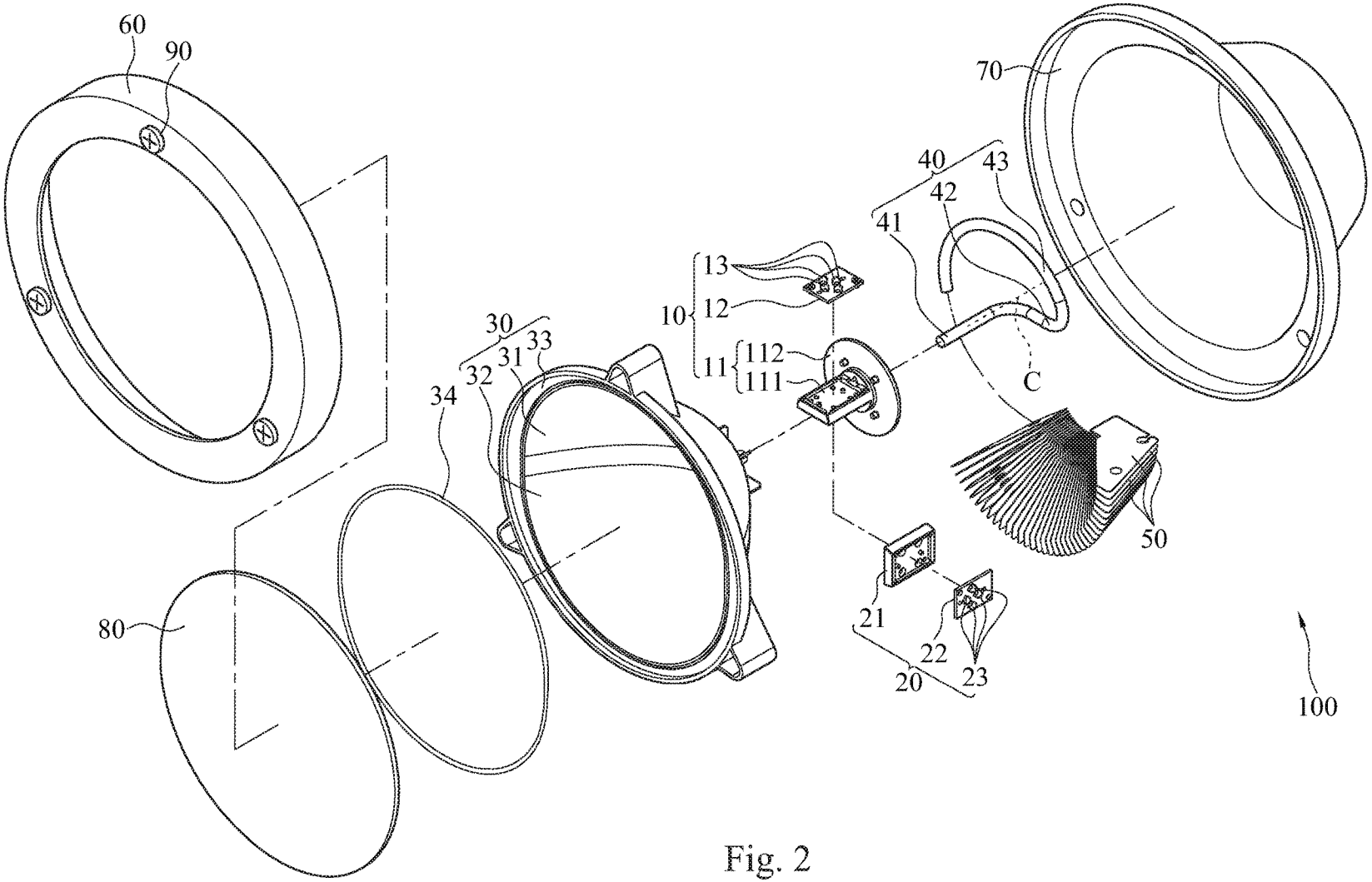
FIG. 2 is an exploded view of an LED illumination apparatus for one embodiment of the instant disclosure.
Figure 3:
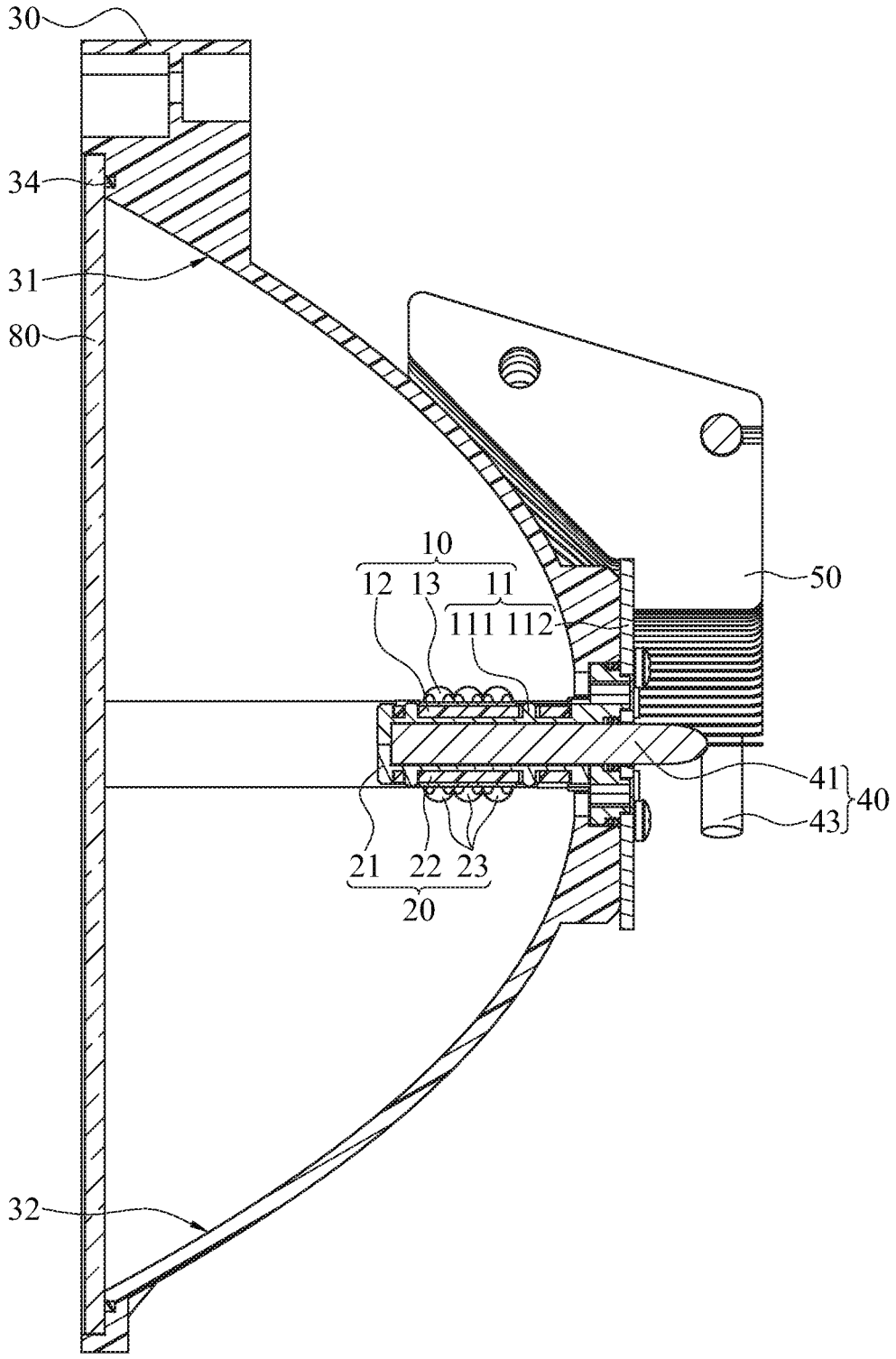
FIG. 3 is a sectional view of an LED illumination apparatus for one embodiment of the instant disclosure with some elements omitted.

Please refer to FIGS. 1 to 3, where FIG. 1 is a schematic view of an LED illumination apparatus for one embodiment of the instant disclosure, FIG. 2 is an exploded view of the LED illumination apparatus for this embodiment of the instant disclosure, and FIG. 3 is a sectional view of the LED illumination apparatus for the same embodiment of the instant disclosure with some elements omitted. For the instant embodiment, an LED illumination apparatus 100 comprises a first lighting module 10, a second lighting module 20, a lamp cup 30, a heat pipe 40, a plurality of heat dissipating fins 50, a front cover 60, a rear cover 70, and a glass cover 80.

The first lighting module 10 includes a first base 11, a first circuit board 12, and a plurality of first light emitting diodes (LEDs) 13. For the instant embodiment, four first LEDs 13 are used for explanatory purposes. In other embodiments, one or more first LED 13 may be disposed depending on the required illumination. The four first LEDs 13 are disposed on the first circuit board 12, which is secured to the first base 11. As shown in FIG. 2, the first base 11 of the instant embodiment has a rectangular shaped tongue portion 111, where the first circuit board 12 is disposed on a first surface of the tongue portion 111.

In addition, for the instant embodiment as shown in FIG. 2, the four first LEDs 13 are arranged in a diamond-like pattern on the first circuit board 12. The first LEDs 13 disposed at the tips of the diamond-like pattern are arranged on the front and rear ends of the first circuit board 12, respectively. Here, the front end of the first circuit board 12 refers to the tip portion on the left-hand side in FIG. 3, while the rear end thereof refers to another tip portion relative to the front end, that is to say the tip portion on the right-hand side in FIG. 3.

The second lighting module 20 includes a second base 21, a second circuit board 22, and a plurality of second LEDs 23. For the instant embodiment, four second LEDs 23 are used for explanatory purposes. In other embodiments, one or more second LED 23 may be disposed depending on the required illumination. The four second LEDs 23 are disposed on the second circuit board 22, which is secured to the second base 21. As shown in FIG. 2, the second base 21 of the instant embodiment is rectangular shaped, where the second circuit board 22 is disposed on a first surface of the second base 21.

Identically, for the instant embodiment as shown in FIG. 2, the four second LEDs 23 are arranged in a diamond-like pattern on the second circuit board 22. The second LEDs 23 disposed at the tips of the diamond-like pattern are arranged on the front and rear ends of the second circuit board 22, respectively. Here, the front end of the second circuit board 22 refers to the tip portion on left-hand side in FIG. 3, while the rear end thereof refers to another tip portion relative to the front end. That is to say the tip portion on the right-hand side in FIG. 3.

As illustrated in FIG. 2, a second surface of the tongue portion 111 of the first base 11 opposite to the first surface of the tongue portion 111 is mated with a second surface of the second base 21 opposite to the first surface of the second base 21. As shown in FIG. 3, after the assembling process is completed, the first LEDs 13 and the second LEDs 23 face opposite directions.

Figure 4:
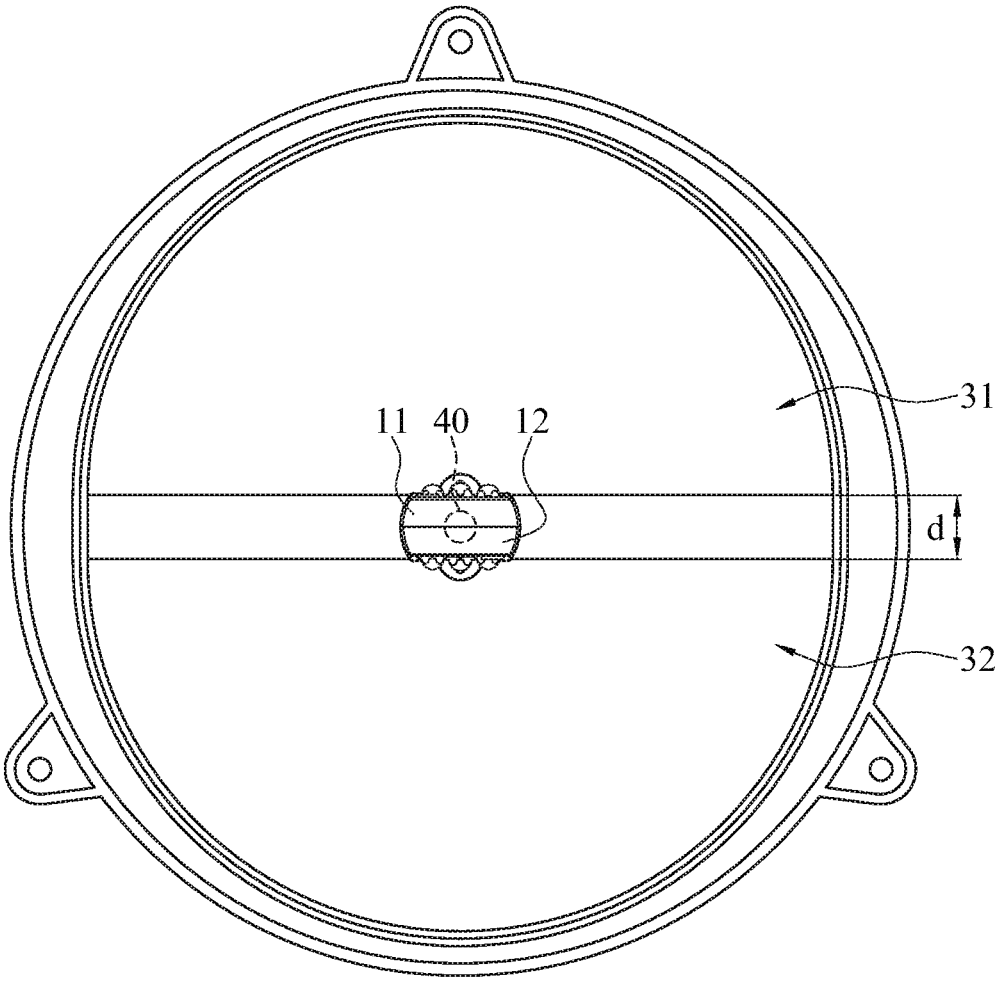
FIG. 4 is a front view of an LED illumination apparatus for a second embodiment of the instant disclosure with some elements omitted.

Please refer to FIGS. 2~4, where FIG. 4 is a front view of the LED illumination apparatus of the instant embodiment omitting the front cover 60, rear cover 70, and glass cover 80. The lamp cup 30 of the instant embodiment includes a first reflecting surface 31, a second reflecting surface 32, and an opening 33. The first reflecting surface 31 and the second reflecting surface 32 are arranged essentially in a symmetrical mirror fashion. The front end of the lamp cup 30 defines an opening 33 for emitting light therefrom. For the instant embodiment, the last described front end of the lamp cup 30 refers to the left-hand side direction in FIG. 3, while the rear end of the lamp cup 30 refers to the right-hand side direction in FIG. 3. The outer side of the lamp cup 30 refers to the surface of the lamp cup 30 on the right-hand side of FIG. 3, while the inner side of the lamp cup 30 refers to the concaved side of the lamp cup 30 on the left-hand side of FIG. 3, that is the locations occupied by the first and second reflecting surfaces 31 and 32.

The first and second reflecting surfaces 31 and 32 can each has its own curvature. For the instant embodiment, they have the same curvatures and form a symmetrical mirror after the assembling process is done. As shown in FIG. 4, the connecting sides of the first and second reflecting surfaces 31 and 32 are formed in a straight line fashion, with a length d of this straight line portion being approximately equal to the thickness of the assembled first and second bases 11 and 21.

As shown in FIGS. 3 and 4, the first and second lighting modules 10 and 20 are received by the lamp cup 30. The first LEDs 13 of the first lighting module 10 are arranged in such a way that they face toward the first reflecting surface 31. The second LEDs 23 of the second lighting module 20 are arranged in such a way that they face toward the second reflecting surface 32. After light is emitted toward the first reflecting surface 31 from the first LEDs 13, the reflected light emits in a direction toward the opening 33. Likewise, after light is emitted toward the second reflecting surface 32 from the second LEDs 23, the reflected light also emits in a direction toward the opening 33. After light beams emitted by the first LEDs 13 are reflected, the light rays form a light field that is hemispherically shaped. Likewise, after light beams emitted by the second LEDs 23 are reflected, the light rays form a light field that is hemispherically shaped. The two hemispherically shaped light fields in the up and down orientation jointly form a light field that is approximately spherically shaped.

Furthermore, to make the reflected light source more concentrated and illuminates farther distance away, the first LED 13 disposed at the front end of the diamond-like pattern can be arranged at the focal point of the first reflecting surface 31. Likewise, the second LED 23 disposed at the front end of the diamond-like pattern can be arranged at the focal point of the second reflecting surface 32. In addition, for easy assembling and minimizing change in reflected light source intensity due to assembling errors, the intersection between two diagonals of the diamond-like pattern and the middle point of the LED disposed at the front end of the diamond-like pattern may match the focal point location of the reflecting surface.

Please refer to FIGS. 2 and 3. In addition to the rectangular tongue shaped portion 111, the first base 11 also has a circular assembling portion 112. The assembling portion 112 is connected to the rear end of the tongue portion 111. As shown in FIG. 3, when the first lighting module 10 is assembled to the lamp cup 30, the tongue portion 111 of the first base 11 protrudes into the lamp cup 30 from the rear thereof, while the assembling portion 112 presses against the rear of the lamp cup 30. Therefore, by adjusting the length of the tongue portion 111 and the position of the first LEDs 13 on the tongue portion 111, when the assembling portion 112 is pressed against the lamp cup 30, the location of the focal point of the first lighting module 10 can match the focal point of the first reflecting surface 31. In addition, the focal point of the second lighting module 20 connected to the first lighting module 10 matches the focal point of the second reflecting surface 32. Thus, the positioning of various parts during the assembling process becomes easier, which reduces the chances of inadequate light intensity after reflection due to assembling errors.

Next, please refer to FIGS. 1~3. The heat pipe 40 is protrudingly disposed in between the first and second bases 11 and 21, in addition to extending toward the rear of the lamp cup 30. For the instant embodiment, the heat pipe 40 includes a straight portion 41, a bent portion 42, and a loop portion 43. The straight portion 41, bent portion 42, and loop portion 43 are connected in sequence. The straight portion 41 is penetratingly disposed in between the first and second bases 11 and 21, for directing the heat generated by the first and second bases 11 and 21. The bent portion 42 and straight portion 41 jointly define an approximately 90° angle, while the loop portion 43 follows a hemispherical path.

As shown in FIG. 2, for the loop portion 43 that extends hemispherically, it defines a virtual central axis C at the center of the hemisphere, with the central axis C perpendicular to the radius thereof. The straight portion 41 is disposed along the central axis C. Please refer to FIG. 4 in conjunction. After assembling, the straight portion 41 is arranged at the center position of the lamp cup 30, such that the loop portion 43 is parallel to the opening 33 of the lamp cup 30 and loops around the outer side surface of the lamp cup 30. For other embodiments, the loop portion 43 may conform to the shape of the outer side surface of the lamp cup 30, such that the loop portion 43 can be curve-shaped in matching the outer circumferential shape of a radial cross-sectional surface of the outer ring-shaped surface of the lamp cup 30.

One end of each of the heat dissipating fins 50 is fitted over the heat pipe 40, with the fins 50 arranged surroundingly along the outer side surface of the lamp cup 30. As can be seen from FIGS. 1~3, the fins 50 are arranged on the loop portion 43 of the heat pipe 40. A particular clearance is defined between adjacent fins 50, with each fin 50 being a thin slice having a particular surface area, such that heat can be dispersed onto each of the fins 50. Thus, the fins 50 can have more contact surface with the air, which allows heat conducted to the fins 50 can be dispersed into air more quickly. Since the fins 50 are fitted over the heat pipe 40, the heat generated by the first and second lighting modules 10 and 20 can be guided to the fins 50 via the heat pipe 40 for dispersion.

As shown in FIG. 3, to allow the fins 50 to have greater heat dissipating areas, while utilizing the inner space of the LED illumination apparatus, each of the fins 50 is slightly trapezoid-shaped. The slanting surface is arranged on the outer side surface of the lamp cup 30. Meanwhile, each of the fins 50 has an extending rectangular portion, which is disposed behind the assembling portion 112 of the first base 11. This rectangular portion also acts to direct the heat of the assembling portion 112 to the fins 50. Each of the fins 50 defines a thru hole at an end portion thereof for fitting the heat pipe 40. As shown in FIGS. 1 and 2, after the fins 50 have been fitted over the loop portion 43 of the heat pipe 40, the fins 50 are arranged surroundingly along the loop portion 43. After assembling, the fins 50 define a shape that features the surrounding arrangement over the outer side surface of the lamp cup 30. By arranging the fins 50 this way, the LED illumination apparatus 100 does not need to increase its volume significantly while still maintaining a certain size and utilizing the available space.

Please refer to FIG. 2. A water-proofing rubber ring 34 can be disposed on the outer circumferential surface of the opening 33 in front of the lamp cup 30. Then, the glass cover 80 can cover the opening 33. By being in between the lamp cup 30 and the glass cover 80, the rubber ring 34 prevents water or water vapor from intruding the lamp cup 30. Next, the front cover 60 is fitted in front of the lamp cup 30, while the rear cover 70 is fitted in the rear of the lamp cup 30. Then, a plurality of screws 90 can be used to secure the front cover 60, lamp cup 30, and rear cover 70 in sequence. In particular, the rear cover 70 can enclose the fins 50 in the rear, with the shape of the rear cover 70 mating to the shape of the outer side surfaces of the fins 50.

Based on the above structures, heat generation can be greatly reduced by the use of LEDs as the light sources. The up-and-down arrangement of the LEDs allows more LEDs to be used in order to achieve required illumination intensity. By manipulating the way that LEDs are arranged and its positions, light beams emitted by the LEDs can be effectively reflected outwardly as much as possible. Meanwhile, by adjusting the shape of curvature of the reflecting surfaces, the reflected light sources can be more concentrated and provides nearly spherical light field. In addition, by penetratingly dispose the heat pipe 40 in between the first and second bases 11 and 21, heat originated from the first and second bases 11 and 21 can be effectively directed to the heat-dissipating fins 50 via the heat pipe 40. Multiple heat-dissipating fins 50 can effectively disperse heat to ambient air for enhancing heat-dissipation effect.

While the instant disclosure has been described by way of example and in terms of the preferred embodiments, it is to be understood that the instant disclosure needs not be limited to the disclosed embodiments. For anyone skilled in the art, various modifications and improvements within the spirit of the instant disclosure are covered under the scope of the instant disclosure. The covered scope of the instant disclosure is based on the appended claims.

What is claimed is:

1. A light-emitting diode (LED) illumination apparatus, comprising:

a first light emitting module including a first base, a first circuit board, and four first LEDs, the four first LEDs being disposed on the first circuit board, faced toward the first reflecting surface and arranged in a diamond-like pattern, the first circuit board being disposed on a first surface of the first base;

a second light emitting module including a second base, a second circuit board, and at least one second LED, the second LED being disposed on the second circuit board and faced toward the second reflecting surface, the second circuit board being disposed on a first surface of the second base, wherein a second surface of the first base opposite to the first surface of the first base is mated with a second surface of the second base opposite to the first surface of the second base;

a lamp cup including a first reflecting surface and a second reflecting surface, the first and second reflecting surfaces being disposed in a symmetrical mirror fashion, the first and second lighting modules being received by the lamp cup;

a heat pipe penetratingly disposed in between the first and second bases, the heat pipe protruding towards the rear of the lamp cup and then extending surroundingly around the heat pipe; and a plurality of heat-dissipating fins, with one end of each of the heat-dissipating fins fitted over the heat pipe, the heat-dissipating fins being arranged surroundingly along the outer side surface of the lamp cup;

wherein the intersection between two diagonals of the diamond-like pattern and a middle point of the first LED disposed at the front end of the diamond-like pattern match the focal point location of the first reflecting surface.

2. The LED illumination apparatus of claim 1, wherein the heat pipe includes a straight portion, a bent portion, and a loop portion, and wherein the straight portion is disposed in between the first and second bases, the bent portion is connected to the straight portion, and the loop portion is connected to the bent portion.

3. The LED illumination apparatus of claim 2, wherein the loop portion extends hemispherically.

4. The LED illumination apparatus of claim 3 wherein the straight portion is disposed along a central axis of the loop portion.

5. The LED illumination apparatus of claim 1, further comprising a front cover, a glass cover, and a rear cover, wherein the glass cover covers an opening defined by the lamp cup, the front cover is disposed in front of the lamp cup, and the rear cover is disposed at the rear of the lamp cup.

6. The LED illumination apparatus of claim 5, further comprising a water-proofing rubber ring, wherein the rubber ring is disposed on the outer circumferential surface of the opening of the lamp cup and in between the lamp cup and glass cover.

7. A light-emitting diode (LED) illumination apparatus, comprising:

a first light emitting module including a first base, a first circuit board, and at least one first LED, the first LED being disposed on the first circuit board, the first circuit board being disposed on a first surface of the first base;

a second light emitting module including a second base, a second circuit board, and at least one second LED, the second LED being disposed on the second circuit board, the second circuit board being disposed on a first surface of the second base, wherein a second surface of the first base opposite to the first surface of the first base is mated with a second surface of the second base opposite to the first surface of the second base;

a lamp cup including a first reflecting surface and a second reflecting surface, the first and second reflecting surfaces being disposed in a symmetrical mirror fashion, the first and second lighting modules being received by the lamp cup;

a heat pipe penetratingly disposed in between the first and second bases, the heat pipe protruding towards the rear of the lamp cup and then extending surroundingly around the heat pipe; and a plurality of heat-dissipating fins, with one end of each of the heat-dissipating fins fitted over the heat pipe, the heat-dissipating fins being arranged surroundingly along the outer side surface of the lamp cup;

wherein the heat pipe includes a straight portion, a bent portion, and a loop portion, and wherein the straight portion is disposed in between the first and second bases, the bent portion is connected to the straight portion, and the loop portion is connected to the bent portion.

8. The LED illumination apparatus of claim 7, wherein the loop portion extends hemispherically.

9. The LED illumination apparatus of claim 8, wherein the straight portion is disposed along a central axis of the loop portion.

10. The LED illumination apparatus of claim 7, further comprising a front cover, a glass cover, and a rear cover, wherein the glass cover covers an opening defined by the lamp cup, the front cover is disposed in front of the lamp cup, and the rear cover is disposed at the rear of the lamp cup.

11. The LED illumination apparatus of claim 10, further comprising a water-proofing rubber ring, wherein the rubber ring is disposed on the outer circumferential surface of the opening of the lamp cup and in between the lamp cup and glass cover.

12. The LED illumination apparatus of claim 7, wherein the first LED of the first lighting module faces toward the first reflecting surface, and the second LED of the second lighting module faces toward the second reflecting surface.

13. The LED illumination apparatus of claim 12, wherein the number of the first LEDs is four and the four first LEDs are arranged in a diamond-like pattern.

14. The LED illumination apparatus of claim 13, wherein the first LED disposed at the front end of the diamond-like pattern is located at the focal point of the first reflecting surface.

* * * * *